United States Patent [19]

Graalmann et al.

[11] 4,243,054

[45] Jan. 6, 1981

[54] METHOD AND APPARATUS FOR FORMING AN EQUALIZED TOBACCO STREAM

[75] Inventors: Gerhard Graalmann, Wohltorf; Heinz Siebert, Hamburg, both of Fed. Rep. of Germany

[73] Assignee: Hauni-Werke Körber & Co. KG., Hamburg, Fed. Rep. of Germany

[21] Appl. No.: 76,208

[22] Filed: Sep. 17, 1979

[30] Foreign Application Priority Data

Sep. 23, 1978 [DE] Fed. Rep. of Germany ..... 2841470

[51] Int. Cl.[3] ..... A24B 7/14; G01G 11/08

[52] U.S. Cl. ..... 131/22 R; 131/108; 131/110; 198/505; 177/21

[58] Field of Search ..... 131/84, 21 R, 21 B, 131/22 R, 108, 110, 145, 146, 149; 177/119, 121; 198/505, 504; 222/55

[56] References Cited

U.S. PATENT DOCUMENTS

| | | | |
|---|---|---|---|
| 3,430,751 | 3/1969 | Bateson | 198/505 |
| 3,494,507 | 2/1970 | Ricciardi | 198/505 X |
| 3,794,049 | 2/1974 | Wochnowski | 131/108 |
| 4,038,531 | 7/1977 | Loe, Jr. | 198/505 |
| 4,163,489 | 8/1979 | Wahl | 131/108 X |

*Primary Examiner*—Stephen C. Pellegrino
*Attorney, Agent, or Firm*—Peter K. Kontler

[57] ABSTRACT

A continuous stream of tobacco leaves is equalized on the endless belt of a weighing device which receives an unequalized stream from a carded conveyor forming part of a tobacco feeding device. The belt is pivotable with an arm of the weighing device in response to changes in the weight of successive increments of tobacco thereon. Such changes in weight are ascertained by a potentiometer and signals denoting the weight are transmitted to a function generator by way of an adding circuit as well as to a multiplying circuit which further receives signals denoting the speed of successive increments on the belt. Signals which are transmitted by the multiplying circuit are used to regulate the speed of the belt so that the product of signals denoting the weight and of corresponding signals denoting the speed of successive increments of tobacco on the belt remains constant. The speed of the conveyor in the feeding device is regulated in response to signals which are transmitted by the function generator and denote the extent and duration of deviation of changes of the signals denoting the weight of successive increments from a given value. Signals denoting the speed of the conveyor can be modified in dependency on signals denoting the speed and/or weight of successive increments to regulate the operation of one or more devices for the processing of tobacco in the equalized stream which leaves the belt of the weighing device.

22 Claims, 3 Drawing Figures

METHOD AND APPARATUS FOR FORMING AN EQUALIZED TOBACCO STREAM

BACKGROUND OF THE INVENTION

The present invention relates to a method and apparatus for building an equalized tobacco stream wherein the weight of each unit length or increment closely approximates or matches a predetermined weight. More particularly, the invention relates to improvements in a method and apparatus for building a continuous equalized tobacco stream by weighing successive increments of an unequalized stream and by changing the speed of movement of such increments along a predetermined portion of an elongated path when the weight of certain increments or series of increments deviates from the predetermined weight. Still more particularly, the invention relates to improvements in tobacco feeding and weighing devices of the type known as BZO and DWB (manufactured and sold by the assignee of the present application).

The weighing device of the type known as DWB comprises an endless conveyor which transports a series of unit lengths of a tobacco stream along a portion of the path for tobacco leaves or the like. The conveyor of the weighing device receives successive unit lengths from a conveyor of the feeding device. The weighing device further includes means for monitoring the weight of successive unit lengths on its conveyor and means for varying the speed of such conveyor when the monitored weight deviates from the predetermined weight. This can be achieved by multiplying first signals denoting the weight of successive unit lengths with second signals denoting the speed of corresponding unit lengths on the conveyor of the weighing device, and varying the speed of such conveyor so that the intensity or another characteristic of third signals denoting the products remains constant. The speed of the conveyor in the feeding device is a function of the speed of the conveyor which forms part of the weighing device. The conveyor which receives the equalized stream from the conveyor of the weighing device is preferably driven at a constant speed.

All operations which are to be performed by the components of a modern production line for the treatment of tobacco leaves prior to destalking are normally carried out in a fully automatic way. As a rule, such components should receive and process a continuous tobacco stream wherein the weight of each unit length matches or closely approximates a predetermined weight. This simplifies the controls of the production line because each and every automatically controlled unit invariably receives identical quantities of tobacco per unit of time. Therefore, such production lines embody weighing devices which are designed to furnish signals denoting the weight of successive unit lengths of the stream, and means for changing the weight when the monitored weight deviates from the desired (predetermined weight). It has been found that equalization of the stream contributes significantly to predictable and optimum treatment (such as conditioning (changing the moisture content) and destalking) of tobacco leaves or the like.

The manner in which the speed of the conveyor of the feeding device is regulated as a function of the speed of the conveyor in the weighing device is such that the throughput of the weighing device (e.g., in kilograms per hour) is constant. A combination of a feeding device and a weighing device which is often used in presently known production lines is shown in FIG. 4 of U.S. Pat. No. 3,903,901. The patented combination can compensate for deviations of the throughput (e.g., in kg/hr) from the average value by ±75 percent, i.e., the speed of conveyors in the two devices can be changed by ±75 percent. It has been found that such range of adjustments is often too narrow, i.e., that it does not suffice to compensate for differences in specific weight of various types of tobacco and/or for differences in the size and/or composition (consistency) of portions of such tobacco. In many instances, the differences between specific weights of different types of tobacco are so pronounced that, even if the tobacco is supplied in such a way that the volumes of successive increments which are delivered to the conveyor of the weighing device are identical, the one or the other limit of the aforementioned range is reached (and normally exceeded) whenever the production line receives a different type of tobacco.

Another reason for insufficiency of the aforediscussed range of adjustments (±75 percent) is that the volume of a stream which consists of a first type of tobacco and is delivered by the feeding device subsequent to delivery of tobacco of a different second type is quite different from the volume of the previously delivered stream. Additional reasons for insufficiency of the aforediscussed range are differences in consistency and/or size of particles of different types of tobacco. As explained above, the inability of the combination of feeding and weighing devices to invariably supply identical quantities of tobacco per unit of time can greatly affect the quality of treatment of tobacco in a production line which extends to or includes the destalking unit.

Attempts to compensate for the aforediscussed relatively narrow range of adjustments include the provision of devices which allow for changes in the transmission ratio of drive means for the conveyors of the feeding and weighing devices. Such transmissions often include chains for transmission of torque between the two conveyors. The chains are replaced with different chains whenever the production line is to receive a different type of tobacco. This is a time-consuming operation which invariably entails complete stoppage of all mobile parts of the production line. Such stoppage causes pronounced losses in output, especially if the processed material is to be supplied directly to a production line for the mass-manufacture of cigarettes or other rod-shaped articles constituting or forming part of smokers' products. Moreover, the upper or lower limit of the aforediscussed range can be reached even if the nature of supplied tobacco is not changed at all. This can occur as a result of pronounced differences between the consistency, particle size, moisture content and/or another characteristic of successive batches of one and the same tobacco type.

OBJECTS AND SUMMARY OF THE INVENTION

An object of the invention is to provide a novel and improved method of forming an equalized tobacco stream wherein the weight of successive unit lengths equals or closely approximates a predetermined weight.

Another object of the invention is to provide a method which is less dependent on the specific weight and/or on the consistency of various types of tobacco than the heretofore known methods.

A further object of the invention is to provide a method of automatically forming an equalized tobacco stream at the rate at which such stream is transported through a modern high-speed production line for treatment of tobacco leaves or the like.

An additional object of the invention is to provide a method which invariably insures that the range of available adjustments suffices for satisfactory equalization of all kinds of tobacco streams irrespective of the type of tobacco of which a stream consists.

Another object of the invention is to provide a novel and improved apparatus for the practice of the above outlined method.

A further object of the invention is to provide the apparatus with novel and improved means which compensates for differences between various types of tobacco and with novel and improved means for regulating the speed of conveyors which transport tobacco in the feeding and weighing devices.

Another object of the invention is to provide a novel and improved operative connection between the just outlined apparatus and one or more machines which receive and process the equalized stream.

One feature of the invention resides in the provision of a method of building an equalized tobacco stream wherein the weight of each unit length equals or at least closely approximates a predetermined weight. The method comprises the steps of respectively conveying successive unit lengths of a tobacco stream (e.g., a stream consisting of whole tobacco leaves which are about to be conditioned to change their moisture content and thereupon treated in a destalking machine to break the ribs from tobacco leaf laminae and to thereupon segregate the ribs from laminae) at variable first and second speeds along first and second portions of an elongated path (such portions can be immediately adjacent to each other and can be defined by two endless conveyors the second of which forms part of a weighing device and the first of which forms part of a device which feeds tobacco leaves to the conveyor of the weighing device), weighing successive unit lengths of the stream in the second portion of the path and generating a first series of signals denoting the weight of the respective unit lengths (to this end, the weighing device can comprise a pivotable arm which carries the second conveyor and pivots against the opposition of a spring or the like in response to movement of successive unit lengths of the stream on the second conveyor, and a potentiometer or another suitable signal generating device which ascertains the extent of pivotal movement of the arm and transmits the signals of the first series), monitoring the second speed (of the conveyor in the weighing device) and generating a second series of signals denoting the speed of successive unit lengths in the second portion, utilizing the first and second signals for the generation of third signals which vary as a function of changes in the weight and/or speed of successive unit lengths on the conveyor of the weighing device (for example, the step of utilizing can include multiplying the first signals, or signals which are derived from first signals, with the corresponding second signals and applying the resulting third signals to an amplifier which regulates the speed of a variable-speed prime mover for the conveyor of the weighing device), varying the second speed when the characteristics of third signals or analogous signals deviate from a predetermined value (e.g., from the reference signal which is transmitted by an adjustable potentiometer or another suitable source of reference signals), and varying the ratio of first and second speeds as a function of the extent and duration of deviation of the characteristics of signals of one of the two series (preferably the signals of the first series) from a preselected value (this can be achieved by resorting to a function generator, an input of which receives the signals of the first series and the output of which transmits signals denoting the extent and duration of deviation of the characteristics of signals of the first series from the preselected value; such signals can be multiplied with or otherwise modified by signals transmitted by the monitoring means for the second speed and the resulting signals can be used to adjust the speed of a variable-speed prime mover for the first conveyor as a function of changes in the intensity or another characteristic of signals at the output of the function generator).

The step of generating signals which are indicative of the extent and duration of deviation of one series of signals from a preselected value can further include the step of establishing a reference signal (preferably a signal which is transmitted by an adjustable potentiometer or the like) and adding the reference signal to the signals of the one series. The resulting signals are thereupon transmitted to the one input of the aforementioned function generator.

The method can further comprise the step of monitoring the first speed (e.g., by resorting to a tachometer generator which is operatively connected with he prime mover for the first conveyor) and generating additional signals denoting the speed of successive unit lengths of the unequalized stream in the first portion of the path, generating further signals denoting the desired or actual characteristics of successive unit lengths of the stream in the second portion of the path (such further signals can be transmitted by a circuit which multiplies each signal of the first series with the corresponding signal of the second series, or by a potentiometer which transmits a reference signal denoting the desired or optimum characteristics of signals at the output of the multiplying circuit), modifying one of the additional and further signals in dependency on the characteristics of the other of the additional and further signals to generate resultant signals, and utilizing such resultant signals to influence the processing of the equalized tobacco stream.

If the streams include or consist of whole tobacco leaves, the processing can include destalking the leaves of the equalized stream in a third portion which can but need not be closely adjacent to the second portion of the path but is evidently located downstream of such second portion so that, as a result of destalking, the leaves are converted into a mixture of ribs and tobacco leaf laminae, and segregating the ribs from laminae or vice versa. The segregating step can include conveying a current of gas (e.g., compressed air) across the mixture (preferably from below) to entrain the relatively lightweight laminae. The step of utilizing the aforementioned resultant signals then preferably includes regulating the rate of fluid flow to the mixture as a function of changes in the characteristics of the resultant signals.

The aforementioned step of modifying one of the additional and further signals can include forming quotients of successive additional and further signals, and such quotients then constitute the aforediscussed resultant signals. The utilization of resultant signals is preferably delayed for an interval of time corresponding to that which is required to advance a unit length of the equalized tobacco stream from the second into the third portion of the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3:
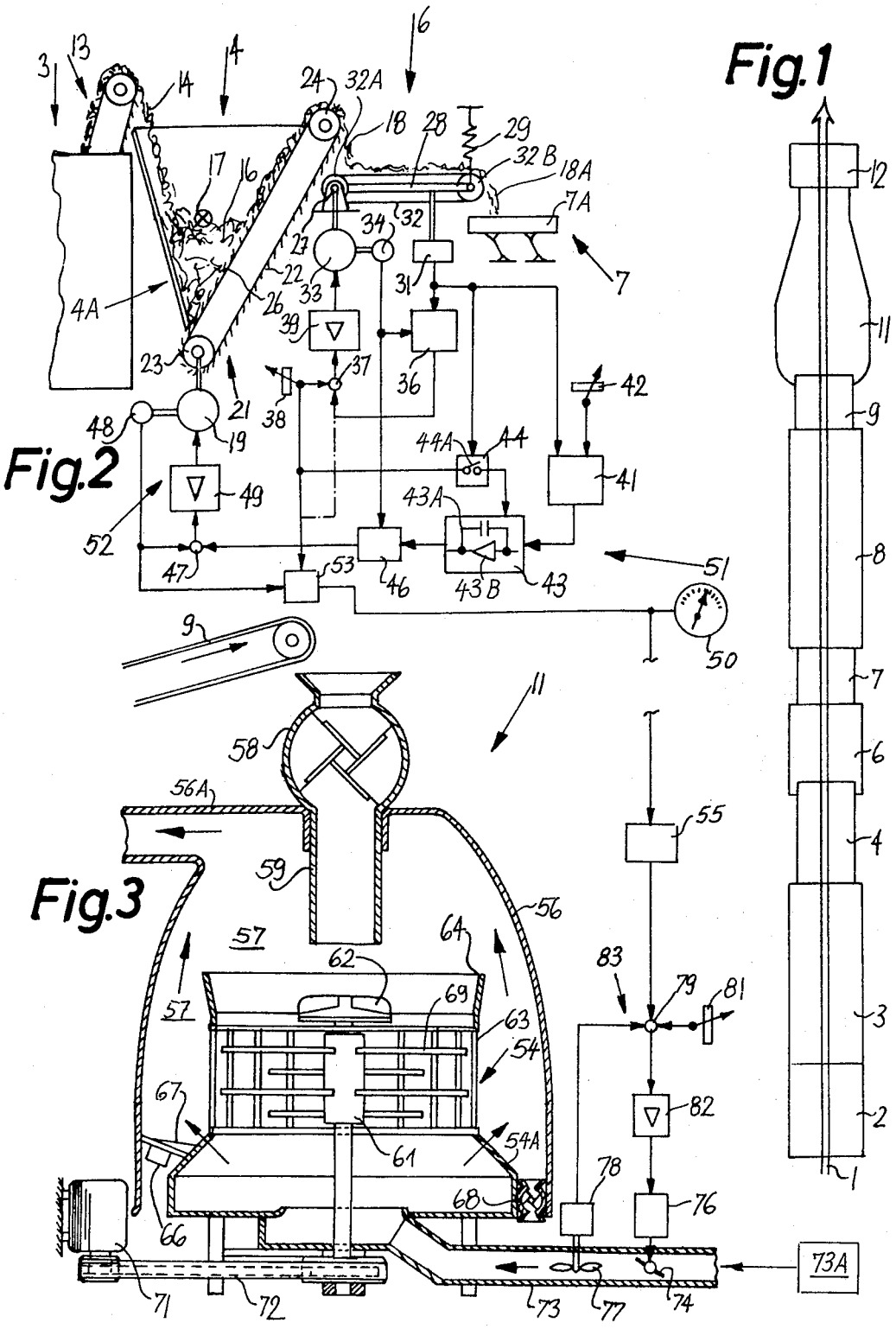
FIG. 1 is a schematic plan view of a production line including an equalizing apparatus which embodies the invention.
FIG. 2 is an enlarged fragmentary schematic elevational view of the equalizing apparatus.
FIG. 3 is a sectional view of a tobacco processing machine which forms part of the production line of FIG. 1 and receives a tobacco stream which is equalized by the apparatus of FIG. 2.

Referring first to FIG. 1, there is shown a complete production line for treatment of tobacco leaves. This line includes (as seen in the direction which is indicated by arrow 1) a device 2 for evacuating the contents of carriages (namely, bales or similar accumulations of tobacco leaves) of the type known as WK, a tobacco loosening and advancing device 3 of the type known as KTBL, a feeding unit 4 similar to that known as BZO, a weighing device 6 which resembles that known as DWB, a vibratory conveyor 7 of the type known as SR, a rotary tobacco conditioning drum 8 of the type known as WH, a band conveyor 9 of the type known as FBC, a vertical tobacco destalking device 11 which is similar to that known as VT 2500 S, and a device 12 for evacuation and transport of tobacco leaf laminae (this device is of the type known as 5 TSE). The aforementioned components (WK, KTBL, etc.) of the production line shown in FIG. 1 are manufactured and sold by the assignee of the present application.

FIG. 2 shows that the loosening and advancing device 3 comprises an endless carded conveyor 13 which delivers a stream of tobacco leaves 14 into a magazine 4A of the feeding unit 4. One side wall of the magazine 4A forms part of a conveyor 21 including an endless belt 26 which is trained over pulleys 23 and 24. The carding (e.g., pins) of the belt 26 is shown at 22. The magazine 4A contains a substantially constant intermediate supply 16 of tobacco leaves 14. The supply 16 is monitored by a level detector system including one or more photocells 17 which form part of a two-point regulating system for the speed of the conveyor 13. This insures that the upper level of the intermediate supply 16 varies very little or not at all. The details of a regulating system which can be used to vary the speed of the conveyor 13 in dependency on changes of the upper level of a supply of tobacco leaves or the like are disclosed in the aforementioned commonly owned U.S. Pat. No. 3,903,301 and in the corresponding commonly owned German Pat. No. 1,914,466 to both of which reference may be had, if necessary.

The belt 26 of the conveyor 21 draws from the supply 16 a continuous unequalized tobacco stream 18 which is caused to travel around the upper pulley 24 and successive increments or unit lengths of which descend onto the upper reach of an endless belt conveyor 32 forming part of the weighing device 6. The conveyor 32 is driven by a variable-speed prime mover 33 (preferably a DC-motor) and is supported by a substantially horizontal arm 28 of the weighing device 6. The arm 28 is pivotable about the horizontal axis of a fulcrum 27. The pulleys for the conveyor 32 are shown at 32A, 32B; the pulley 32A is driven by the prime mover 33 so that the upper reach of the conveyor 32 advances in a direction to the right, as viewed in FIG. 2. The stream 18 is converted into an equalized stream 18A during travel with the upper reach of the conveyor 32, and successive unit lengths of the equalized stream 18A (wherein the weight of each unit length is identical with or closely approximates a predetermined weight) are thereupon delivered into the trough 7A of the vibratory conveyor 7. That end portion of the arm 28 which is remote from the fulcrum 27 is biased upwardly by one or more helical springs 29 or other suitable biasing means (e.g., one or more weights suspended on cords and attached to the arm 28 in such a way that the right-hand end portion of the arm tends to move upwardly).

The left-hand pulley 32A for the conveyor 32 is coaxial with the fulcrum 27. The arm 28 supports the conveyor 32 and the equalized tobacco stream 18A in that portion of an elongated path for tobacco leaves which extends above the upper reach of the conveyor 32. The preceding portion of such path is defined by the conveyor 21 of the feeding unit 4, and the next-following portion of such path is defined by the trough 7A of the vibratory conveyor 7.

The arm 28 cooperates with a first signal generating device 31 here shown as an adjustable potentiometer 31 whose wiper (not specifically shown) is displaced in response to pivoting of the arm 28 about the axis of the fulcrum 27. Such pivoting takes place under the action of gravity which is normally assisted by the weight of tobacco leaves 14 on the conveyor 28 or under the action of the biasing means 29. The means for transmitting motion from the arm 28 to the wiper of the potentiometer 31 includes a connecting rod 31A or the like. The output of the potentiometer 31 transmits a series of signals which are indicative of the weight of successive unit lengths of the tobacco stream 18A on the belt 32. Such signals are transmitted to one input of a multiplying (signal modifying) circuit 36 and to one input of an adding circuit 41.

The speed of the prime mover 33, and hence the speed of the conveyor 32, is monitored by a second signal generating device 34 which is a tachometer generator and whose output is connected to a second input of the multiplying circuit 36 as well as to one input of a second multiplying circuit 46. The signals of the series of signals appearing at the output of the tachometer generator 34 denote the speed of corresponding unit lengths of the tobacco stream on the conveyor 32.

The multiplying circuit 36 may be of the type described on pages 1179 to 1190 of the publication entitled "Taschenbuch der Nachrichtenverarbeitung" by K. Steinbuch (published 1962 by Springer Verlag, Federal Republic Germany). The signal at the output of the circuit 36 is transmitted to one input of a signal comparing stage 37 another input of which receives a reference signal from a suitable source 38 (e.g., an adjustable potentiometer). The output of the stage 37 is connected with an operational amplifier 39 which controls the speed of the prime mover 33. The amplifier 39 regulates the speed of the prime mover 33 in such a way that the product of a first signal (from the potentiometer 31) denoting the weight of a unit length of the tobacco stream on the conveyor 32 and a second signal (from the tachometer generator 34) denoting the speed of such unit length on the belt conveyor 32 is constant or nearly constant.

The other input of the adding circuit 41 is connected with a source 42 (e.g., an adjustable potentiometer) of reference signals. The arrangement is such that the intensity of the signal at the output of the adding circuit 41 is zero if the intensity of signals at the two inputs of this circuit is identical. The output of the circuit 41 is connected with one input of a function generator 43. The intensity of signal at the output of the function generator 43 is dependent on the extent and duration of change of the input signal (this is the so-called PI-behavior of the function generator). As shown in FIG. 2, the function generator 43 may comprise a capacitor 43A which is connected in parallel with an operational amplifier 43B.

Another input of the function generator 43 can be connected with the output of the potentiometer 38 during the initial stage of operation of the apparatus. The connection comprises a threshold circuit 44 having a switch 44A which can be opened or closed in response to signals from the potentiometer 31. The potentiometer 38 charges the capacitor 43A of the function generator 43 when the potentiometer 31 closes the switch 44A.

The outputs of the function generator 43 and of the tachometer generator 34 are connected to the respective inputs of the multiplying circuit 46 whose output is connected to one input of a signal comparing stage 47. Another input of the stage 47 is connected to a tachometer generator 48 which monitors the speed of a variable-speed prime mover 19 (preferably a DC-motor) for the conveyor 21, and the output of the stage 47 is connected with an operational amplifier 49 for the motor 19. The amplifier 49 forms part of a control circuit 52 for the motor 19. The reference character 51 denotes a regulating unit which includes the function generator 42, the multiplying circuit 46, the signal comparing stage 47 and the tachometer generator 48. The regulating unit 51 adjusts the control unit 52 so as to insure that the ratio of speeds of the conveyors 21 and 32 (i.e., the ratio of speeds of the prime movers 19 and 33) can be changed automatically as a function of the extent and duration of a change in the characteristics of signals which are transmitted by the signal generating device 31 and/or 34.

The amplifier 49 evaluates the signals from the function generator 43 (subsequent to modification of such signals by the multiplying circuit 46) and varies the speed of the conveyor 21 accordingly, i.e., in dependency on the extent and duration of deviation of signals from the function generator 43 from a given value.

The circuitry of FIG. 2 further comprises a dividing circuit 53 for signals which are transmitted by the potentiometer 38 and tachometer generator 48. Instead of being connected with the potentiometer 38, one input of the dividing circuit 53 can receive signals from the output of the multiplying circuit 36; this is shown in FIG. 2 by a phantom line. The output of the dividing circuit 53 is connected with one input of a signal comparing stage 79 (FIG, 3) by an analog time-dely unit 55. The stage 79 forms part of circuitry which controls the operation of the tobacco destalking device 11. The connection between the dividing circuit 53 and time-delay unit 55 includes a gauge 50 which indicates the intensity or another characteristic of signals transmitted to the stage 79. The delay which is effected by the time-delay unit 55 corresponds to the interval of time which is required to transport a unit length of the equalized tobacco stream 18A from the conveyor 32 of the weighing device 6 into the tobacco destalking device 11.

The destalking device 11 is of the upright type and comprises a destalking unit 54 which is installed in a housing 56 in such a way that these parts define a classifying chamber 57 wherein the ribs are segregated from tobacco leaf laminae. The chamber 57 surrounds the unit 54 and a portion thereof is disposed above this unit. The outlet 56A of the housing 56 discharges tobacco leaf laminae into the evacuating device 12.

The band conveyor 9 delivers whole tobacco leaves 14 to an inlet including a air lock 58 which feeds the leaves to the unit 54 by way of a vertical pipe 59 in the housing 56. The leaves descend into the range of a distributor 62 which is driven by an upright rotor 61 for a set of knives 69 rotating in a stationary basket 63 which allows separated ribs and laminae to leave the unit 54 and to enter the lower portion of the chamber 57 by moving radially of and away from the rotor 61. The distributor 62 is spacedly surrounded by a stationary funnel 64 on top of the basket 63.

The lower end of the chamber 57 is closed by a spiral-shaped bottom wall 67 which may consist of sheet metal and is agitated by a vibrator 66. Tobacco ribs which descend onto the upper side of the bottom wall 67 are caused to enter an air lock 68 for evacuation from the housing 56. The means for intercepting and collecting the separated ribs is not specifically shown in the drawing.

The means for transmitting torque to the rotor 61 for the knives 69 comprises an electric motor 71 and a suitable transmission 72 (e.g., a transmission including one or more V-belts). A pipe or conduit 73 serves as a means for supplying compressed gas (preferably air) for segregation of ribs from tobacco leaf laminae. The pipe 73 discharges air into the space below the basket 63, and such air enters into the chamber 57 by way of a foraminous conical wall 54A of the unit 54. The inlet of the pipe 73 is connected to a suitable source 73A of compressed gaseous fluid.

The means for regulating or influencing the rate of airflow into the housing 56 comprises a butterfly valve 74 in the pipe 73. The position of this valve (and hence the rate of airflow into the housing 56) is adjustable by a servomotor 76 which is controlled by an amplifier 82. The latter receives signals from the output of the aforementioned signal comparing stage 79. As explained hereinabove, one input of the stage 79 receives signals from the dividing circuit 53 via time-delay unit 55. Another input of the stage 79 is connected to a source 81 (e.g., an adjustable potentiometer) of reference signals, and a third input of the stage 79 is connected to the output of a signal generator 78 which is driven by a propeller 77 in the pipe 73. When the rate of fluid flow in the pipe 73 changes, the RPM of the propeller 77 also changes and the intensity or another characteristic of the signal at the output of the generator 78 changes accordingly. The reference character 83 denotes a control circuit arrangement which includes the signal generator 78, stage 79, potentiometer 81 and amplifier 82.

When necessary, the control circuit arrangement 83 changes the angular position of the valve 74.

The operation:

Successive increments or unit lengths of the unequalized stream 18 which is formed and transported lengthwise and away from the intermediate supply 16 by the belt 26 of the conveyor 21 in the feeding unit 4 are advanced over the pulley 24 and descend onto the upper reach of the conveyor 32 close to the fulcrum 27. This insures that dynamic forces which develop as a result of impingement of successive increments of the stream 18 upon the upper reach of the conveyor 32 cannot adversely influence the weighing action of the device 6. In other words, the lever arm of an increment which descends onto the conveyor 32 is practically nil because the locus of impingement of successive increments of the stream 18 upon the conveyor 32 is close to the fulcrum 27. Successive increments thereupon advance toward the pulley 32B whereby their influence upon the angular position of the arm 28 (against the opposition of the spring 29) increases. The right-hand end of the arm 28 moves up and down, depending on the weight of successive increments, and thereby causes the potentiometer 31 (via connecting rod 21A) to generate a series of signals each denoting the weight of the corresponding increment. The length of the path portion along which the increments move in the course of the weighing operation is determined by the length of the upper reach of the conveyor 32 and by the locus of impingement of increments which are fed by the belt 26.

Successive signals (first series) which are generated by the potentiometer 31 are transmitted to the corresponding input of the multiplying circuit 36 which further receives a series of signals (second series) from the tachometer generator 34, such signals denoting the speed of transport of successive increments of the tobacco stream above the arm 28. The output of the multiplying circuit 36 transmits voltage signals to the corresponding input of the signal comparing stage 37. Such voltage signals are indicative of the products of successive first signals (from the potentiometer 31) and of successive corresponding second signals (from the tachometer generator 34). Each voltage signal is a function of the speed of transport of tobacco along the path portion which is defined by the conveyor 32 and of the weight of the corresponding increment of the stream (i.e., of the extent to which such increment causes the arm 28 to pivot clockwise against the opposition of the spring 29).

The signal comparing stage 37 further receives reference signals from the potentiometer 38; such reference signals are indicative of the desired voltage at the output of the multiplying circuit 36. If the intensity of the reference signals deviates from the intensity of voltage signals, the stage 37 transmits a signal to adjust the amplifier 39, i.e., to change the speed of the prime mover 33 for the conveyor 32. The amplifier 39 is adjusted in such a way that the product of the first and second signals (output signal of the circuit 36) remains constant or reassumes a desired value with a minimum of delay as soon as the stage 37 detects a deviation from the desired value (intensity of signal transmitted by the potentiometer 38).

For example, if the weight of successive increments of the stream on the conveyor 32 increases, the intensity of first signals (at the output of the potentiometer 31) also increases.The nature of signals which the stage 37 then transmits to the amplifier 39 is such that the speed of the prime mover 33 is reduced. Inversely, when the extent to which the arm 28 is pivoted clockwise (against the opposition of the spring 29) decreases, the weight of successive increments of the stream is below the predetermined weight. The speed of the prime mover 33 is then increased. If the condition of the stream on the conveyor 32 matches that which is selected by adjustment of the potentiometer 42, the signal at the left-hand input of the adding circuit 41 matches and cancels the reference signal from the potentiometer 42 (such signals have opposite signs), i.e., the intensity of signal at the output of the adding circuit 41 is zero. The output of the function generator 43 then transmits a signal of given intensity (voltage) to the corresponding input of the multiplying circuit 46. Such signal is multiplied by the signal from the tachometer generator 34 (i.e., it is modified by a signal which is a function of the speed of the conveyor 32), and the resulting signal is transmitted to the stage 47 to constitute a reference signal. The stage 47 further receives a signal from the tachometer generator 48; when the intensity of such signal deviates from the signal at the output of the multiplying circuit 46, the amplifier 49 for the prime mover 19 is adjusted to change the speed of the conveyor 21 in the feeding unit 4. It will be noted that the speed of the conveyor 21 is a function of the speed of the conveyor 32. The intensity of signal at the output of the function generator 43 is constant when the signal at the output of the circuit 41 is zero; under such circumstances, the speed of the conveyor 21 is only a function of the speed of the conveyor 32.

If the weight of successive increments on the conveyor 32 increases, the output of the circuit 41 transmits a negative signal and such negative signal causes the function generator 43 to reduce the intensity of the signal at its output (owing to the aforementioned PI behavior of the function generator). Consequently, the intensity of the signal at the output of the multiplying circuit 46 also decreases whereby the voltage of electric current supplied to the prime mover 19 by the amplifier 49 decreases, i.e., the RPM of the prime mover 19 is reduced and the speed of the conveyor 21 decreases. The RPM of the prime mover 19 decreases until the weight of successive increments on the conveyor 32 also decreases to such an extent that the intensity of signal at the output of the adding circuit 41 is zero. Thus, the consistency of the stream on the conveyor 32 of the weighing device 6 then matches that which is selected by the setting of the potentiometer 42. Inversely, the speed of the prime mover 19 is increased when the weight of successive increments of the stream on the conveyor 32 is less than the desired (predetermined) weight.

When the production line is started, the magazine 4A is normally empty or contains less than the optimum quantity of tobacco leaves, i.e., the upper level of the intermediate supply 16 is likely to be below that level at which the illustrated photocell 17 transmits a signal denoting that the quantity of tobacco in the magazine 4A is at an optimum value. In the absence of any remedial action, the speed of the prime mover 19 would be increased to an extremely high value whenever the quantity of tobacco leaves on the conveyor 32 is zero or well below the average value. Therefore, the upper input of the function generator 43 is then connected with the potentiometer 38 via closed switch 44A of the threshold circuit 44. The potentiometer 38 connects the function generator 43 with a source of electrical energy so as to charge the capacitor 43A. This insures that the speed of the prime mover 19 is not overly increased while the weighing device 6 is about to receive tobacco leaves 14, i.e., during starting of the production line. When the leaves 14 reach the conveyor 32 of the weighing device, the arm 28 pivots clockwise, as viewed in FIG. 2, and causes the rod 31A to adjust the potentiometer 31 which, in turn, transmits a signal to the threshold circuit 44 to open the switch 44A and to thereby disconnect the potentiometer 38 from the capacitor 43A. From there on, the speed of the conveyor 21 is regulated in the aforedescribed manner, i.e., the ratio of the speeds of conveyors 21, 32 is changed as a function of the extent and duration of deviation of first signals (from the potentiometer 31) from a desired value, i.e., as a function of deviation of the weight of successive increments on the conveyor 32 from the predetermined weight.

Since the tobacco stream 18A is constant owing to appropriate adjustment of the conveyor 21 which delivers the unequalized stream 18 to the weighing device 6, the density multiplied by the volume and speed of successive unit lengths of the stream 18 equals the product of weight and density of successive unit lengths of the stream 18A, and such product is constant.

It is assumed that the height of the unequalized stream 18 on the conveyor belt 26 is constant or nearly constant. Therefore, the density of the stream 18 can be said to equal A multiplied by one and divided by the speed of the belt 26. A denotes a factor corresponding to the aforementioned constant. Such factor varies in response to changes in adjustment of the potentiometer 38, i.e., in dependency on the desired weight of successive unit lengths of the stream 18A.

The signal at the output of the dividing circuit 53 is a function of the desired consistency of the stream 18A (see the potentiometer 38 which is connected with one input of the circuit 53) and of the velocity of the stream 18 (whose volume is assumed to be constant). Therefore, the quotient signal at the output of the dividing circuit 53 is independent of the volume of the stream 18A but is always proportional to the density of this stream.

The signal at the output of the dividing circuit 53 is delayed by the unit 55 so as to account for the interval of time which is needed to transport a unit length of the stream 18A from the discharge end of the conveyor 32 to the inlet (air lock 58 shown in FIG. 3) of the tobacco destalking device 11. Such signal then reaches the corresponding input of the signal comparing stage 79 to be compared with signals from the potentiometer 81 and signal generator 78.

The operation of the destalking device 11 of FIG. 3 is as follows:

The leaves 14 which are delivered by the conveyor 9 enter the housing 56 via air lock 58 and pipe 59 to be spread out in the funnel 64 by the distributor 62 which is driven by the rotor 61. The leaves 14 then enter the basket 63 of the unit 54 and are propelled outwardly by the knives 69 which cooperate with the adjacent stationary parts of the basket to separate the ribs from tobacco leaf laminae. The mixture of ribs and laminae enters that portion of the chamber 57 which surrounds the basket 63.

The current of air which is delivered by the pipe 73 enters the lowermost portion of the chamber 57 via foraminous wall 54A and entrains the laminae upwardly toward and into the outlet 56A for transport into the evacuating device 12. The ribs (which are heavier than laminae) descend onto the bottom wall 67 and slide therealong toward and into the air lock 68 which is located at the lowermost point of the chamber 57.

The angular position of the valve 74 is regulated in dependency on the intensity of reference signal furnished by the potentiometer 81. The intensity of this signal is selected in dependency on the specific weight of tobacco leaves 14 which are delivered into the magazine 4A to form the intermediate supply 16. The speed of the gaseous fluid in the pipe 73 is monitored by the propeller 77 and signal generator 78. The signals (voltage) at the output of the signal generator 78 are indicative of such speed; these signals are transmitted to the stage 79 together with delayed signals from the output of the dividing circuit 53 and with the reference signal from the potentiometer 81. The stage 79 transmits a signal to the amplifier 82 to change the angular positon of the valve 74 whenever the sum of intensities of signals transmitted to the stage 79 deviates from zero. This insures that the classifying operation in the chamber 57 invariably results in segregation of a maximum percentage of tobacco leaf laminae from ribs.

An important advantage of the improved equalizing apparatus including the feeding unit 4 and weighing device 6 is that it is not necessary to interrupt the operation of the production line when one desires to change the type of material which is to be conditioned, destalked and/or otherwise processed. This is due to the fact that the ratio of the speed at which the conveyor 21 delivers the unequalized stream 18 to the speed of the conveyor 32 is automatically changed as a function of the extent and/or duration of deviation of signals transmitted by the potentiometer 31 and/or tachometer generator 34 from predetermined values. It has been found that such regulation of the speeds of conveyors 21 and 32 invariably insures that the range of adjustability suffices to guarantee satisfactory equalization of a tobacco stream irrespective of the brand, size, specific weight, moisture content and/or other characteristics of its constituents. The apparatus which is shown in FIG. 2 changes the ratio of speeds of the conveyors 21 and 32 in dependency on changes in the weight of successive increments of the stream 18A (signals furnished by the potentiometer 31). However, it is equally within the purview of the invention to change such ratio as a function of the extent and duration of signals furnished by the tachometer generator 34 from a predetermined value because such signals are dependent on signals from the potentiometer 31. In either event, the range of necessary adjustments of the ratio of speeds of conveyors 21 and 32 during processing of a certain type of tobacco is surprisingly narrow. This not only insures that the maximum range of adjustments is amply sufficient to allow for the processing of all kinds of tobacco but also that the uniformity of the stream 18A is surprisingly high. In other words, the vibratory conveyor 7 receives equal quantities of tobacco per unit of time irrespective of whether such unit of time is relatively long (e.g., one hour) or much shorter (e.g., a small fraction of one hour). This is desirable and advantageous for obvious reasons, i.e., the weight of the stream 18A does into exhibit pronounced long-range and/or short-range fluctuations.

The provision of adding circuit 41 (this circuit actually compares the signals from 31 and 42) contributes to sensitivity of the system which regulates the speed of the conveyor 21 in the feeding unit 4. The circuit 41 enables the function generator 43 to transmit a signal which is indicative of the extent and duration of deviation of the intensity of signals transmitted by the potentiometer 31 from a given value. The signal at the output of the function generator 43 is multiplied (in the cirucit 46) with the signal from the tachometer generator 34, and the resulting signal (at the output of the adding circuit 46) is used to regulate the speed of the conveyor 21.

The adjustability of the potentiometer 42 renders it possible to select a basic mode of operation which insures that the ratio of speeds of the conveyors 21, 32 will be satisfactory for a large number of different tobacco types. As mentioned above, the circuit 41 adds the signal from the potentiometer 42 to signals which are transmitted by the potentiometer 31 (instead, the signal from 42 could be added to signals which are transmitted by the tachometer generator 34 because the product of the signals from 31 and 34 is constant, i.e., the ratio of intensities of signals from 31 and 34 is also constant or nearly constant). At the present time, one input of the circuit 41 is preferably connected to the potentiometer 31. This insures that the controls of the weighing device 6 operate without any delay. The circuit 41 actually determines the quantity of tobacco on the conveyor 32 of the weighing device 6.

If the changes of the volume of the stream 18 in response to admission of different tobacco types into the magazine 4A are not very pronounced, changes in speed of the conveyor 21 can be said to denote differences between the specific gravities of different tobacco types. In other words, if the height of a stream 18 consisting of a first type of tobacco is the same as or close to the height of a stream 18 consisting of a second tobacco type but the weight of unit lengths of the two streams is different, it is clear that the specific weight of the second type of tobacco is different from the specific weight of the first type of tobacco. The extent to which the speed of the conveyor 21 is changed in response to formation of a stream 18 consisting of a second type of tobacco is then indicative of differences between specific gravities of the two tobacco types. At the very least, changes in the speed of the conveyor 21 are indicative of a tendency of the specific weight of tobacco in the stream 18 to change. This is utilized to regulate the admission of classifying fluid (air) via conduit 73. In other words, the signal which is transmitted by the dividing circuit 53 and is delayed by the unit 55 is indicative of the speed of the conveyor 21 and, therefore (under the aforediscussed circumstances), of the specific gravity of tobacco which is fed by the conveyor 21. Such signal is quite satisfactory for regulation of the pneumatic classifying action in the chamber 57 of the destalking device 11 in dependency on the specific weight of the material of destalked leaves. By the same token, one could form another signal which is indicative of another characteristic (e.g., moisture content) of tobacco in the magazine 4A and use such signal to regulate the operation of another component (e.g., conditioning drum 8) in the production line of FIG. 1. It is further clear that signals denoting identical or different characteristics of tobacco in the magazine 4A could be used to regulate the operation of two or more discrete components (processing units, such as 8 and 11) in the production line of FIG. 1 or a similar or analogous production line.

Without further analysis, the foregoing will so fully reveal the gist of the present invention that others can, by applying current knowledge, readily adapt it for various applications without omitting features, that, from the standpoint of prior art, fairly constitute essential characteristics of the generic and specific aspects of our contribution to the art and, therefore, such adaptations should and are intended to be comprehended within the meaning and range of equivalence of the appended claims.

We Claim:

1. A method of building an equalized tobacco stream wherein the weight of each unit length at least approximates a predetermined weight, comprising the steps of respectively conveying successive unit lengths of a tobacco stream at variable first and second speeds along first and second portions of an elongated path; weighing successive unit lengths in said second portion and generating a first series of signals denoting the weight of the respective unit lengths; monitoring said second speed and generating a second series of signals denoting the speed of successive unit lengths in said second portion; utilizing said first and second signals for the generation of third signals which vary as a function of changes in the weight and/or speed of successive unit lengths; varying said second speed when the characteristics of said third signals deviate from a predetermined value; and varying the ratio of said first and second speeds as a function of the extent and duration of deviation of the characteristics of signals of one of said series from a preselected value.

2. The method of claim 1, wherein said utilizing step includes multiplying each signal of said first series with the corresponding signal of said second series.

3. The method of claim 1, wherein said ratio varying step includes generating fourth signals which are indicative of the extent and duration of said deviation of the characteristics of signals of said one series, modifying said fourth signals in dependency on the characteristics of signals of the other of said series, and utilizing the thus modified fourth signals for changing said first speed.

4. The method of claim 3, wherein said modifying step includes multiplying said fourth signals with the signals of said other series.

5. The method of claim 3, wherein said step of generating said fourth signals includes establishing a reference signal and adding said reference signal to the signals of said one series.

6. The method of claim 5, wherein said reference signal is variable.

7. The method of claim 3, wherein the signals of said one series are the signals of said first series.

8. The method of claim 1, further comprising the steps of monitoring said first speed and generating fourth signals denoting the speed of successive unit lengths of the stream in said first portion of said path, generating fifth signals denoting the desired or actual characteristics of successive unit lengths of the stream in said second portion of said path, modifying one of said fourth and fifth signals in dependency on the characteristics of the other of said fourth and fifth signals to generate sixth signals, and utilizing said sixth signals to influence the processing of the equalized tobacco stream.

9. The method of claim 8, wherein the step of modifying one of said fourth and fifth signals in dependency on the characteristics of the other of said fourth and fifth signals includes forming quotients of successive fourth and fifth signals, said quotients constituting said sixth signals.

10. The method of claim 8, wherein said streams include tobacco leaves and said processing includes destalking the leaves of the equalized stream in a third portion of said path downstream of said second portion so that the destalked leaves are converted into a mixture of ribs and tobacco leaf laminae, and segregating said laminae from said ribs, said segregating step including conveying a current of gaseous fluid across said mixture to entrain the laminae and said step of utilizing said sixth signals including regulating the rate of fluid flow as a function of changes in the characteristics of said sixth signals.

11. The method of claim 8, further comprising the step of delaying the utilization of successive sixth signals for an interval of time corresponding to that which is required to advance a unit length of the equalized stream from said second into said third portion of said path.

12. Apparatus for building an equalized tobacco stream wherein the weight of each unit length at least approximates a predetermined weight, comprising means for feeding an unequalized tobacco stream from a first to a second portion of an elongated path, including a first conveyor defining said first portion; and a weighing device including a second conveyor defining said second portion of said path and receiving successive unit lengths of the unequalized stream from said first conveyor, variable-speed prime mover means for said second conveyor, first signal generating means including means for monitoring said second portion of said path and for transmitting a first series of signals denoting the weight of successive unit lengths of the tobacco stream on said second conveyor, second signal generating means including means for monitoring the speed of said second conveyor and for transmitting a second series of signals denoting the speed of successive unit lengths of the tobacco stream on said second conveyor, means for modifying the characteristics of signals of one of said series in dependency on the characteristics of corresponding signals of the other of said series to generate third signals, means for changing the speed of said prime mover means, when necessary, in response to deviation of characteristics of said third signals from a given value, and means for varying the speed of said first conveyor to thereby change the ratio of speeds of said first and second conveyors, said speed varying means including means for generating fourth signals denoting the extent and duration of deviation of the characteristics of signals of one of said first and second series from a preselected value and means for evaluating said fourth signals to vary the speed of said second conveyor accordingly.

13. The apparatus of claim 12, wherein said modifying means includes means for multiplying the signals of said first series with the corresponding signals of said second series.

14. The apparatus of claim 13, wherein said means for generating said fourth signals includes a function generator.

15. The apparatus of claim 12, wherein said feeding means further comprises discrete second variable-speed prime mover means for said first conveyor.

16. The apparatus of claim 15, wherein said means for generating said fourth signals includes a function generator and said evaluating means includes means for multiplying successive fourth signals with the corresponding signals of the other of said series to generate fifth signals and means for varying the speed of said second prime mover means as a function of changes in the characteristics of said fifth signals.

17. The apparatus of claim 16, wherein said means for generating said fourth signals further includes a source of reference signals and means for adding the signals of said one series to said reference signals and for transmitting modified signals of said one series to said function generator.

18. The apparatus of claim 12, wherein said fourth signals denote the extent and duration of deviation of the characteristics of signals of said first series from a preselected value.

19. The apparatus of claim 12, further comprising a device for processing the equalized stream in a third portion of said path downstream of said second portion and means for regulating the operation of said device including means for monitoring the speed of said first conveyor and for generating fifth signals denoting the speed of said first conveyor, means for modifying said fifth signals as a function of the characteristics of signals of one of said first and second series to generate sixth signals, and means for influencing the operation of said device in dependency on deviation of the characteristics of said sixth signals from a given value.

20. The apparatus of claim 19, wherein the equalized stream contains whole tobacco leaves and said device includes means for converting said leaves into a mixture of lighter and heavier particles.

21. The apparatus of claim 20, wherein said device further comprises classifying means for segregating the lighter particles from the heavier particles of said mixture and said influencing means includes means for regulating the operation of said classifying means in dependency on changes in the characteristics of said sixth signals.

22. The apparatus of claim 21, wherein said classifying means includes a source of compressed fluid and conduit means for conveying the fluid from said source to said mixture so that the conveyed fluid can entrain the lighter particles, said last named regulating means including means for varying the rate of fluid flow in said conduit means.

* * * * *